US011852116B2

(12) United States Patent
Brown

(10) Patent No.: US 11,852,116 B2
(45) Date of Patent: Dec. 26, 2023

(54) WATER TOWER-BASED APPARATUSES AND METHODS

(71) Applicant: Trevor Brown, Lake Geneva, WI (US)

(72) Inventor: Trevor Brown, Lake Geneva, WI (US)

( * ) Notice: Subject to any disclaimer, the term of this patent is extended or adjusted under 35 U.S.C. 154(b) by 0 days.

(21) Appl. No.: 17/748,397

(22) Filed: May 19, 2022

(65) Prior Publication Data

US 2022/0372945 A1 Nov. 24, 2022

Related U.S. Application Data

(60) Provisional application No. 63/326,042, filed on Mar. 31, 2022, provisional application No. 63/256,159, filed on Oct. 15, 2021, provisional application No. 63/191,432, filed on May 21, 2021.

(51) Int. Cl.
*F03B 13/06* (2006.01)

(52) U.S. Cl.
CPC ..... *F03B 13/06* (2013.01)

(58) Field of Classification Search
CPC ..... F03B 13/06
See application file for complete search history.

(56) References Cited

U.S. PATENT DOCUMENTS 4,284,899 A * 8/1981 Bendiks ..... F03B 13/06 290/1 R
2008/0253837 A1* 10/2008 Miller ..... F03B 13/06 405/80
2009/0152871 A1* 6/2009 Ching ..... F03B 1/00 415/916
2012/0326444 A1* 12/2012 Chang ..... F03B 13/06 290/52

FOREIGN PATENT DOCUMENTS

WO WO-2020050676 A1 * 3/2020 ..... F03B 11/00

* cited by examiner

*Primary Examiner* — Viet P Nguyen
(74) *Attorney, Agent, or Firm* — Fitch, Even, Tabin & Flannery, LLP

(57) ABSTRACT

An apparatus can comprise a water tower that itself comprises an elevated water reservoir, at least one water conduit coupled between the elevated water reservoir and an external water distribution system, and at least a first water turbine disposed and configured to receive water via the at least one water conduit and to exit water to the external water distribution system. The apparatus can further comprise a generator that operably couples to that water turbine. The water tower can further include a speed-increasing gearbox that operably couples between an output shaft of the first water turbine and that generator. The apparatus optionally includes at least one electrolyzer operably coupled to receive both water and/or electricity sourced by the aforementioned water tower. The apparatus can also include at least one hydrogen-powered generator that receives hydrogen from the electrolyzer and that burns that hydrogen to generate electricity.

1 Claim, 2 Drawing Sheets

WATER TOWER-BASED APPARATUSES AND METHODS

RELATED APPLICATION(S)

This application claims the benefit of U.S. Provisional application No. 63/191,432, filed May 21, 2021, U.S. Provisional application No. 63/256,159, filed Oct. 15, 2021, and U.S. Provisional application No. 63/326,042, filed Mar. 31, 2022, all of which are incorporated by reference in their entirety herein.

TECHNICAL FIELD

These teachings relate generally to water storage and distribution systems.

BACKGROUND

Water distribution systems are known in the art. Many such systems include a water towers. Generally speaking, a water tower comprises a man-made structure that includes an elevated water reservoir. That water is available, via assisted or unassisted gravity feed, for local consumption and/or to distribute elsewhere.

BRIEF DESCRIPTION OF THE DRAWINGS

This application presents water tower-based apparatuses and methods that are described in the following detailed description, particularly when studied in conjunction with the drawings, wherein.

Figure 1:
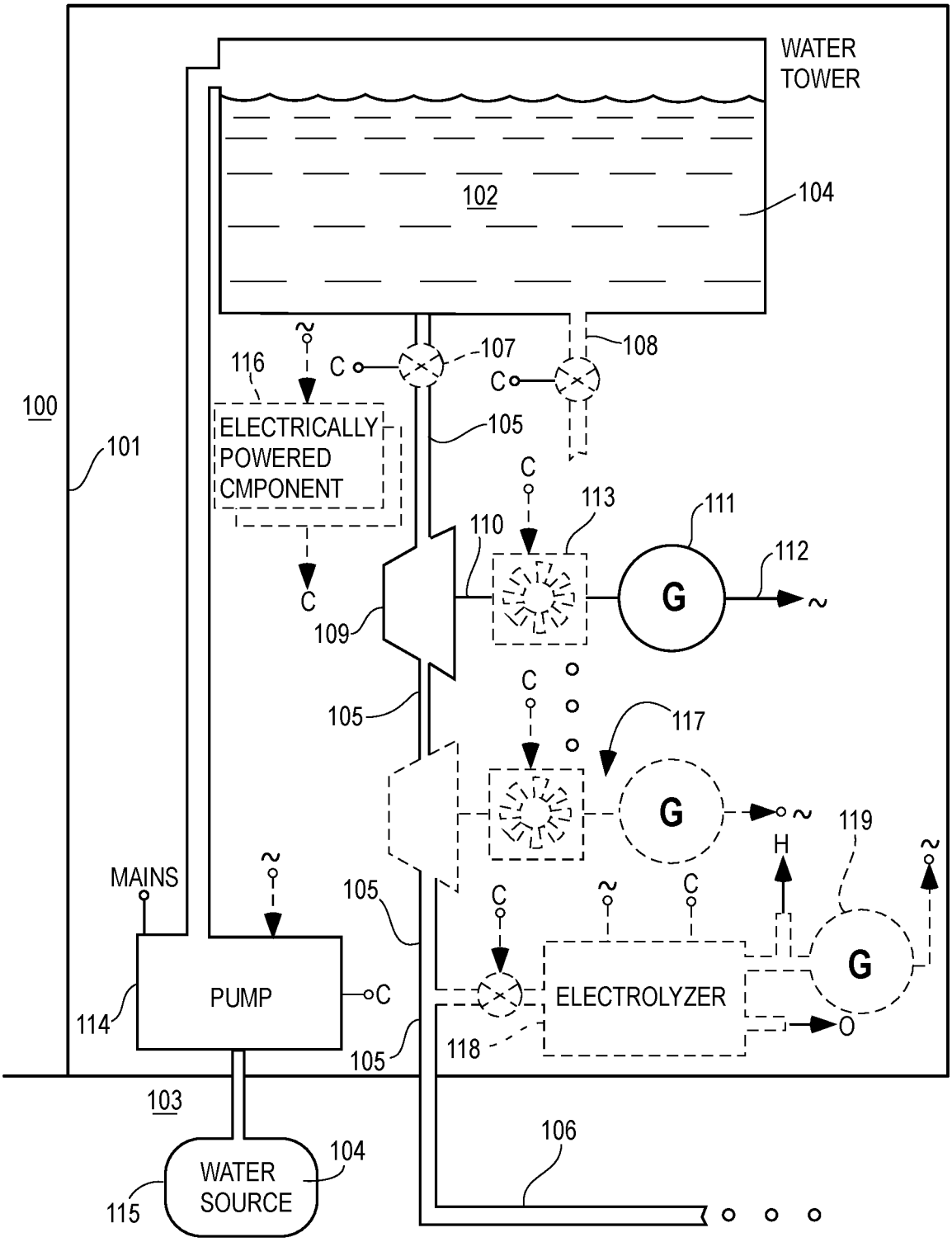
FIG. 1 comprises a schematic block diagram as configured in accordance with various embodiments of these teachings.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated.

DETAILED DESCRIPTION

Generally speaking, pursuant to these various embodiments, an apparatus can comprise a water tower that itself comprises an elevated water reservoir, at least one water conduit coupled between the elevated water reservoir and an external water distribution system, and at least a first water turbine disposed and configured to receive water via the at least one water conduit and to exit water to the external water distribution system. The apparatus can further comprise a generator that operably couples to that water turbine. By one approach, the water tower can further include a speed-increasing gearbox that operably couples between an output shaft of the first water turbine and that generator.

By one approach, the water tower includes one or more electrically-powered components that are at least partially powered by electricity that is generated by the generator. Examples include, but are not limited to, one or more supercomputers, a data center, and so forth.

By one approach, the apparatus optionally includes at least one electrolyzer operably coupled to receive both water and/or electricity sourced by the aforementioned water tower. In such a case, the apparatus can also include at least one hydrogen-powered generator that receives hydrogen from the electrolyzer and that burns that hydrogen to generate electricity. At least some of that generated electricity can serve to power one or more components of the water tower.

These teachings are highly flexible in practice and will accommodate various modifications and/or supplemental features as desired. By one approach, and as one example, the apparatus may include at least one compressed air source that operably couples to the aforementioned external water distribution system and which is configured to selectively impart compressed air into that external water distribution system. By one approach, that compressed air source is controlled, at least in part, by computing facilities that are located within the aforementioned water tower.

As another example, these teachings will accommodate operably coupling at least a second water tower to the aforementioned water tower such that the former can be at least partially filled with water from the latter by hydrostatic pressure while the aforementioned water tower generates electricity via the aforementioned water turbine.

By one approach, the water reservoir of the water tower can be at least partially filled during evening hours using grid electricity when energy rates are typically at their lowest daily level. During daytime hours, when water usage is typically greater (as compared to evening hours), the flow of water exiting the water tower concurrently serves to generate electricity that can either be utilized within the water tower to avoid the higher costs of daytime electricity or that can at least be partially sold back into the grid. So configured, by so leveraging the varying costs of energy, operation of the water tower and/or other related (or even unrelated) electrically-powered components can be achieved at reduced costs.

These and other benefits may become clearer upon making a thorough review and study of the following detailed description. Referring now to the drawings, and in particular to FIG. 1, an illustrative apparatus 100 that is compatible with many of these teachings will now be presented.

In this example, the apparatus 100 includes a water tower 101. These teachings are highly flexible in these regards. The water tower 101 may comprise a purpose-dedicated structure, or it may comprise a multi-purpose structure. In the latter regard, the water tower 101 may include, for example, offices, commercial and/or industrial facilities, residential space, and so forth. As another example, and as discussed below, the water tower 101 may also house such things as one or more supercompute and/or data center(s).

The water tower 101 includes at least one elevated water reservoir 102. The expression "elevated" as used herein refers to being at least partially raised above a local ground level 103. In this illustrative example, the entirety of the water reservoir 102 is raised higher than the local ground level 103 (such as the ground immediately beneath the water tower 101). The capacity of the elevated water reservoir 102 can vary with the needs and/or opportunities of a given application setting. Generally speaking, these teachings are likely to better leverage water reservoirs having a larger, rather than a smaller, capacity. Useful capacity ranges certainly include hundreds of thousands of gallons to millions of gallons of capacity.

These teachings will accommodate using potable water 104, and such is presumed for the purposes of this illustrative description. That said, non-potable water may also serve in an appropriate application setting. In this example, water 104 is provided to the elevated water reservoir 102 via one or more pumps 114 that pump the water 104 from a corresponding water source 115 such as, but not limited to, an underground aquifer, a river or lake, and so forth.

The water tower 101 also includes at least one water conduit 105 coupled between the elevated water reservoir 102 and an external water distribution system 106. By one optional approach, that water conduit 105 may include a valve 107 that can control the flow of water 104 down through the conduit 105. Such a valve 107 may be hand controlled and/or may be selectively controllable via electrical control signaling C. So configured, the flow of water 104 down through the conduit 105 may be selectively completely shut off, may be completely opened to allow maximum flow, or may be set at some in-between level of flow.

If desired, the water tower 101 may include additional such conduits 108. The routing of such additional conduits 108 may be as desired.

The water tower 101 also includes within itself at least a first water turbine 109 that is disposed and configured to receive water 104 via the aforementioned water conduit 105 and to exit water 104 to the external water distribution system 106 (via, for example, a continuation of the aforementioned water conduit 105). Water turbines are known in the art and serve to convert a flow of water into rotational mechanical energy via an output shaft 110. As these teachings are not overly sensitive to any particular selections in these regards, further elaboration regarding water turbines is not provided here for the sake of brevity.

The aforementioned water turbine output shaft 110 operably couples to a generator 111 that converts the aforementioned rotational mechanical energy into electricity 112. As with water turbines, generators are also well known in the art. Accordingly, further elaboration regarding generators is not provided here for the sake of brevity.

By one optional approach, the water tower 101 may also include a speed-increasing gearbox 113 that is operably coupled between the output shaft 110 of the water turbine 109 and the aforementioned generator 111. The increased rotational speed provided in this way can help provide an increased amount of generated electricity at any given rate of water flow through the turbine 109.

So configured, the water tower 101 serves the significant purpose of issuing water to an external water distribution system 106 that may serve to provide pressurized water to, for example, a nearby community or industrial center. At the same time, the water tower 101 leverages that flow of water (which may comprise a constant flow of water at least during daytime hours) to generate electricity. These teachings will accommodate providing more than one such turbine/generator assembly as generally denoted by reference 117. Additional such turbines can be serially connected to the aforementioned water conduit 105 or may be coupled in parallel to the above-described turbine 109 via other water conduits (such as the water conduit denoted by reference 108).

The generated electricity can be utilized in a variety of ways. In one application setting, the generated electricity may be at least partially stored, for example, in a bank of batteries (not shown). By another approach, the electricity is immediately applied and/or distributed without any intermediary storage.

By one approach, the generated electricity at least partially powers one or more electrically-powered components 116 that are located within and hence comprise a part of the water tower 101. These teachings will accommodate a variety of electrically-powered components 116. As one example in these regards, this generated electricity may be utilized, at least part of the time, by the aforementioned pump 114. (The latter may also be coupled to mains electricity to ensure operating power when no electricity is being locally generated.) Less obvious examples in these regards include one or more desalination plants, one or more control circuits, supercomputers, and/or one or more data centers.

Supercomputers are generally understood to comprise a computer with a high level of performance as compared to a general-purpose computer. By one approach, at least one of these electrically-powered components 116 provides control signaling to other components of the water tower 101, such as the aforementioned pump 114, one or more water flow valves (such as the valve denoted by reference 107), the engagement status and/or the settings of the aforementioned gearbox 113, and so forth.

A data center is generally understood to comprise a group of networked computer servers typically used by organizations for the remote storage, processing, or distribution of large amounts of data. As used herein, the expression "data center" will also be understood to include such things as crypto currency mining and block chain ledger maintenance facilities.

It will be understood that electricity generated by the aforementioned generator 111 can also be distributed and applied external to the water tower 101. As but one example in these regards, such electricity can be applied to power external electrically-powered components such as control circuits, supercomputers, and data centers. Such external electrically-powered components may comprise vertically organized building infrastructure to facilitate the ease with which such components are cooled, heat is exited from such components, and with which such components are managed and operated.

Such electrically-powered components, whether they are internal to the water tower 101 or external thereto, can be employed to serve any of a wide variety of purposes. These purposes can range from the ordinary and everyday to more significant and wide-ranging purposes. Examples in the latter regards include controlling, at least in part, the autonomous or semi-autonomous operation of a wide variety of vehicles and/or other systems including ambient environmental control systems.

By one approach, in lieu of the foregoing or in combination therewith, the apparatus 100 may include at least one electrolyzer 118. Such an optional electrolyzer 118 may comprise a part of the water tower 101 (as illustrated) or may be external to the water tower 101. This electrolyzer 118 is operably coupled to receive water from the water tower reservoir 102, from which the electrolyzer 118 separates and provides hydrogen and oxygen. When the water tower 101 includes a turbine powered generator 111 as described above, the electrolyzer 118 can be operably coupled to receive operating electricity generated thereby. When the water tower 101 includes a suitable control circuit as an electrically-powered component, the latter can be operably coupled to the electrolyzer 118 to at least partially control operation thereof.

Hydrogen generated by the electrolyzer 118 can be provided to a hydrogen-powered generator 119 that generates corresponding electricity. That generated electricity can then be distributed within and/or external to the water tower 101 in a manner similar or identical to that described above. The foregoing can include providing electricity to one or more components of the water tower 101 itself.

As noted above, these teachings are highly flexible in practice. As one illustrative example in these regards, and referring now to FIG. 2, the apparatus 100 can further include at least a second water tower 201 that is operably coupled to the above-described water tower 101 and configured to be at least partially filled with water 104 from the first water tower 101 by hydrostatic pressure (alone) even while the above-described water turbine/generator assembly serves to cause the generation of electricity. If desired, the above-described hydrostatic pressure-based filling process can be reversed to permit water from the second water tower 201 to flow and at least partially fill the first water tower 101.

Figure 2:
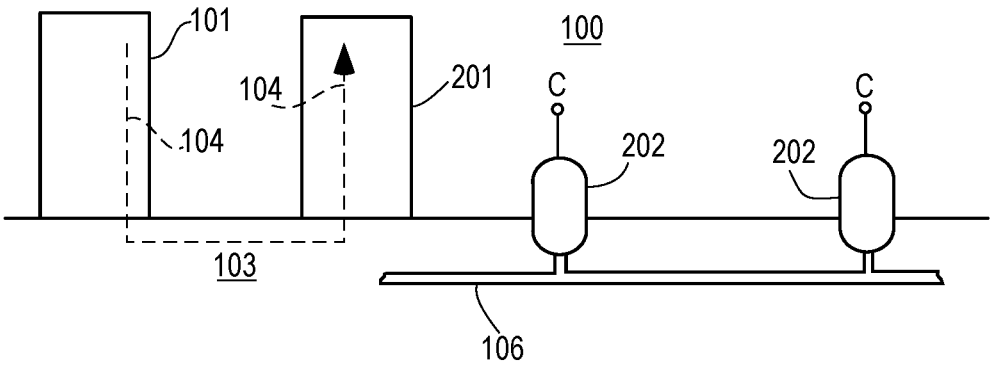
FIG. 2 comprises a schematic block diagram as configured in accordance with various embodiments of these teachings.

As another illustrative example, and with continued reference to FIG. 2, one or more compressed air sources 202 can be operably coupled to the external water distribution system 106. These compressed air sources 202 can be selectively controlled, if desired, by control signals sourced by electrically-powered components 116 that are internal to the water tower 101 or that are external thereto. So configured, these compressed air sources 202 can be selectively controlled to impart compressed air into the external water distribution system 106 to thereby help ensure at least a minimal pressure level within that system.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. An apparatus comprising:

a first water tower comprising:

an elevated water reservoir;

at least one water conduit coupled between the elevated water reservoir and an external water distribution system;

a water turbine disposed and configured to receive water via the at least one water conduit and to exit water to the water distribution system;

a speed-increasing gearbox operably coupled to an output shaft of the water turbine;

a generator having an input operably coupled to an output of the speed-increasing gearbox;

at least one electrolyzer operably coupled to receive both water and electricity sourced by the water tower and to output generated hydrogen;

a hydrogen-powered generator operably coupled to receive the generated hydrogen and to output corresponding hydrogen-generated electricity;

least a first electrically-powered component that is at least partially powered by electricity that is generated by the generator, wherein the first electrically-powered component comprises at least one of a data center and a supercomputer; and at least a second electrically-powered component that is at least partially powered by electricity that is generated by the hydrogen-powered generator, wherein the second electrically-powered component comprises at least one of a data center and a supercomputer that facilitates controlling, at least in part, operation of the external water distribution system; and at least a second water tower that is operably coupled to the first water tower and configured to be at least partially filled with water from the first water tower by hydrostatic pressure while the water turbine serves to cause the generation of electricity.

* * * * *